United States Patent [19]

Vornberger et al.

[11] 4,436,237

[45] Mar. 13, 1984

[54] AUTOMATIC FIRING SYSTEM FOR PNEUMATIC TOOLS

[75] Inventors: George F. Vornberger; John P. Crutcher, both of Cincinnati, Ohio

[73] Assignee: Senco Products, Inc., Cincinnati, Ohio

[21] Appl. No.: 321,772

[22] Filed: Nov. 16, 1981

[51] Int. Cl.[3] ..... B25C 1/04; F01D 25/06

[52] U.S. Cl. ..... 227/130; 91/461

[58] Field of Search ..... 91/5, 461; 227/120, 227/130, 156

[56] References Cited

U.S. PATENT DOCUMENTS 3,808,620 5/1974 Rothfuss et al. ..... 227/130 X 4,211,352 7/1980 Zilka ..... 227/130

FOREIGN PATENT DOCUMENTS 53-22672 3/1978 Japan ..... 227/130

*Primary Examiner*—Paul A. Bell

*Attorney, Agent, or Firm*—Frost & Jacobs

[57] ABSTRACT

There is disclosed an automatic firing system for pneumatic tools wherein there is a remote valve to produce actuation of the main valve of the device which remote valve has only one moving part, combined with a selector valve, by means of which the tool may be converted from single fire to auto-fire modes, and in the auto-fire mode the rate of fire may be controlled. The pneumatic circuitry is such that less compressed air is used than in conventional auto-fire tools and thus the tool is more economical than prior art tools.

10 Claims, 7 Drawing Figures

AUTOMATIC FIRING SYSTEM FOR PNEUMATIC TOOLS

BACKGROUND OF THE INVENTION

Automatic firing pneumatic hand tools such as staplers and nailers have been in use for some years. In such tools, generally the main valve controlling the access of air to the piston is pneumatically operated by a remote valve which is trigger actuated. The remote valve operates within a reciprocable sleeve. By means of a setting of the selector valve the sleeve may be caused to reciprocate so that as the trigger is held in its depressed condition, the reciprocation of the sleeve will produce an auto-fire mode of operation.

DISCLOSURE OF THE INVENTION

According to the present invention, the trigger valve is a unitary valve which is movable from an at rest position to an operative position to produce actuation of the main valve of the tool. The selector valve is of a novel design which in the single fire position permits the tool to operate much as other single fire tools have operated in the past, but which in the auto-fire position produces a repetitive reversal of flow direction without the intermediary of a reciprocating sleeve.

BRIEF DESCRIPTION OF THE DRAWINGS

FIG. 3 is a view similar to FIG. 2 showing the tool in the active position.

DETAILED DESCRIPTION OF THE INVENTION

Figure 1:
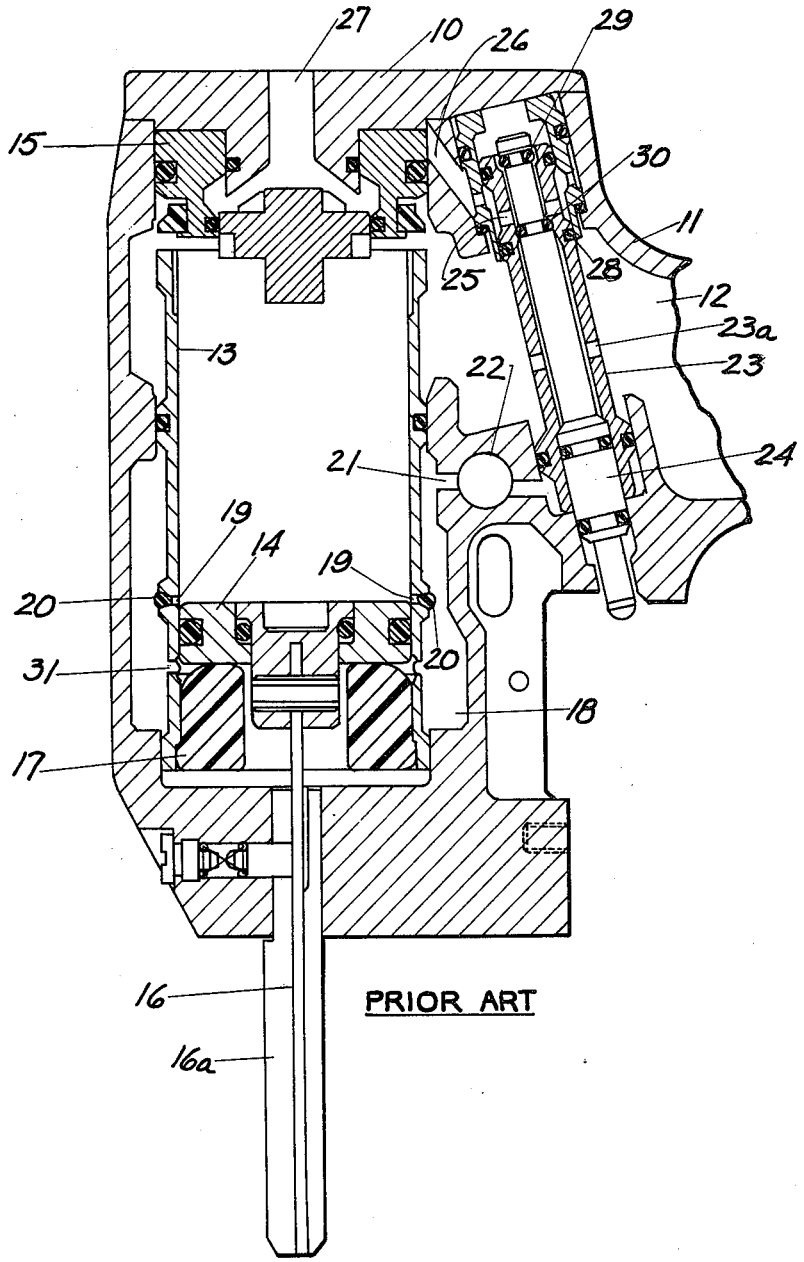
FIG. 1 is an exemplary view in cross section, with parts omitted, of a conventional prior art auto-fire tool.

Taking up first a typical tool of the prior art the tool comprises a body 10 having a handle portion 11 which is hollow and to which a simply of air under pressure is introduced through a conventional fitting and a hose (not shown). The tool will also have a magazine which is not shown.

Within the body there is a cylinder sleeve 13 within which a piston 14 may reciprocate. A main valve is indicated at 15 and in this figure is shown in the open position. Attached to the piston 14 is the driver 16 which impacts the nail or staple to be driven. The stroke of the piston is terminated by means of a bumper 17 at the bottom of the cylinder sleeve. Surrounding the cylinder sleeve 13 is a return air chamber 18. An access to this space is provided through ports 19 in cylinder sleeve 13 and the return air in the chamber 18 is prevented from escaping by the O-ring check valve 20.

The return air chamber 18 communicates through a port 21 with the selector valve 22, which in turn communicates with the sleeve 23 of the remote or trigger valve.

The trigger valve sleeve 23 is reciprocable and the trigger core 24 operates within the sleeve 23. At the upper end a port 25 in the sleeve 23 communicates with a passage 26 which communicates with space above the main valve 15. Air above the piston is exhausted at 27.

In the idle position of the tool, high pressure air in the handle 12 can pass through ports **23*a* in sleeve 23, around the O-ring 30, and through the passage 26 to the area above the piston 15. Air in the chamber 12 is, of course, also applied to the underside of the piston 15 but since the area at the top of the piston is greater than that below the piston, the valve is held in position seated on the cylinder sleeve 13**.

When the trigger core 24 is actuated, the air above the valve 15 exhausts through the passage 26 and the port 25 and around the O-ring 29 to atmosphere. When the air above the valve 15 is exhausted, the pressure in the chamber 12 acting on the underside of valve 15 can raise the valve off its seat and admit high pressure air into the cylinder sleeve 13 to act upon the piston 14 and produce a driving stroke. At the bottom of the stroke, the ports 19 in the cylinder sleeve are exposed to the high pressure air in the cylinder sleeve which passes past the check valve 20 into the return air chamber 18. Thence it passes through the trigger valve passage 21 and selector valve 22 and on to the oscillating trigger valve sleeve 23, causing it to move upward to expose the chamber above the firing valve to high pressure air, since air entering the ports **23*a* in the sleeve can then pass the O-ring 30 and pass on to the passage 26 via port 25. The high pressure air reaching the upper side of the main valve 15 causes it to seat on the cylinder sleeve 13 and expose the high pressure air on top of the piston driver assembly to exhaust through 27. The high pressure air exhausting to atmosphere permits the trapped high pressure air in the return storage chamber and under the oscillating trigger valve sleeve 23 to pass back through the openings 31 to cause the piston driver assembly to move back to its uppermost position. At this point, the high pressure air under the piston driver assembly is exhausted to atmosphere through openings in the guide body 16*a*. The reduction of pressure to atmospheric pressure in the return air chamber 18 and at the oscillating trigger valve sleeve 23 allows the oscillating trigger valve sleeve 23 to move to its bottom position. This movement of the oscillating trigger valve sleeve 23 of course exposes the space above the firing valve 15 to exhaust via passage 26, port 25 and about O-ring 29. The cycle is repeated as long as the trigger valve 24** is depressed.

In the single fire mode, the selector valve 22 does not permit air from the return air chamber 18 to operate on the oscillating trigger valve sleeve 23 and therefore only a single shot is fired. The Rothfuss, et al. U.S. Pat. No. 3,808,620 teaches a tool of the general type just described.

Figure 2:
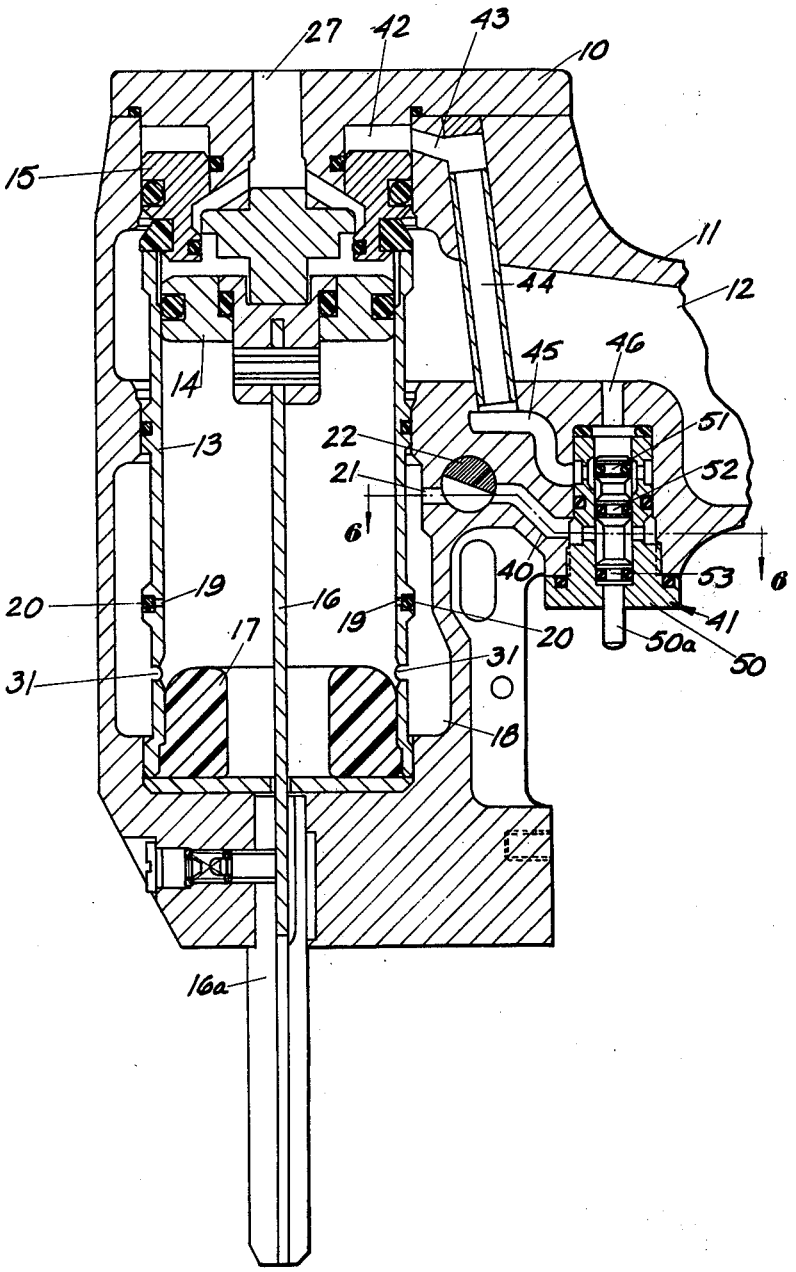
FIG. 2 is a cross sectional view, with parts omitted, of a tool according to the present invention in the idle position.

The present invention is disclosed in the preferred embodiment in FIGS. 2 and 3. Again the tool has the body 10 and the handle member 11 which is hollow to accept air under pressure from a source (not shown) as described above. Again the body is provided with a cylinder sleeve 13 within which a piston 14 is arranged to reciprocate. A main valve is indicated at 15 and a driver is secured to the piston 14 as indicated at 16. A bumper may again be provided at the bottom of the cylinder sleeve 13 as indicated at 17. The housing embodies the return air chamber 18 as before, and again the ports 19 are provided with the O-ring check valve 20. A remote or trigger valve assembly 41 is provided comprising a valve housing 50 and a valve core 50*a*. The return air chamber 18 communicates through the port 21 with the selector valve 22 and this in turn communicates through the port 40 with the trigger housing 50.

The space 42 above the main valve communicates through a passage 43 and a tube 44 and a passage 45 with the valve housing 50. A port 46 also communicates with the valve housing 50.

The valve core 50*a* is provided with three spools indicated, respectively, at 51, 52 and 53. It will be seen that in the idle position (FIG. 2) high pressure air from the chamber 12 communicates through the port 46 and through the valve housing 50, the passage 45, the tube 44, the passage 43, to the space 42 above the main valve 15, thus holding the main valve in position seated on the cylinder sleeve 13. The spool 52 blocks the high pressure air from the port 40. Assuming now that the selector valve 22, which will be described in more detail hereinafter, is placed in the auto-fire position and the valve core 50*a* is actuated by the tool trigger (not shown) to move it up to the position of FIG. 3, the space 42 above the main valve 15 is connected through the passage 43, the tube 44, the passage 45, the valve housing 50, the passage 40, the selector valve 22, the passage 21 to the return air chamber 18. Since the volume of air in the space 42 is small in relation to the volume of the return air chamber 18, the air pressure above the valve 15 is reduced sufficiently so that the high pressure air 12 below the valve 15 can lift the valve off its seat on the cylinder sleeve 13 and thereby expose the piston 14 to the high pressure air 12.

This causes the piston with its driver to move downward in the driving stroke. When the piston reaches the bottom of its stroke, the ports 19 are exposed to the high pressure air in chamber 12, which passes through the ports 19 past the O-ring check valve 20 and the return air chamber 18, the port 21, the selector valve 22, the passage 40, the valve housing 50, the passage 45, the tube 44, and the passage 43, to the chamber 42 above the firing valve. Since the area on top of the firing valve 15 is greater than its area on the bottom (both of which are exposed to the high pressure air) the firing valve will close and seat on the cylinder sleever 13. In this position, the high pressure air above the piston 14 is exhausted at 27. The high pressure air which has been trapped in the return air chamber 18 passes back through the ports 31 in the cylinder sleeve 13 and acts on the underside of the piston 14 to move it back to its uppermost position. The excess high pressure air under the piston driver assembly is exhausted to atmosphere through the guide body 16*a*.

With the pressure in the return air chamber 18 at atmosphere and by virtue of the connection through the passage 21, the selector valve 22, the valve housing 50, the passage 45, tube 44 and passage 43, the pressure above the firing valve 15 is also at atmosphere. Therefore, the high pressure air in the chamber 12 can again lift the firing valve 15 off its seat and the cycle is repeated so long as the valve core 50*a* is actuated by the tool trigger (not shown).

In effect, therefore, the high pressure air cycles back and forth between the space 42 above the firing valve 15 and the return air chamber 18, through the passage 43, tube 44, passage 45, the valve housing 50, the passage 40, the selector valve 22 and the passage 21. High pressure air is only exhausted through the guide body 16*a* at the end of a return stroke of the piston. Thus, the consumption of high pressure air is materially reduced over the conventional type of auto-fire tool.

With the selector valve 22 in the single-fire position and the parts at rest, as in FIG. 2, high pressure air again passes through the passage 46, the passage 45, the tube 44 and the passage 43 to the space 42 above the firing valve 15, thus holding the valve on its seat on the cylinder sleeve 13.

When the valve core 50*a* is actuated to the position of FIG. 3, the space 42 above the valve 15 is exhausted through the passage 43, the tube 44, the passage 45 the valve housing 50, the passage 40, and finally around the stem of selector valve 22, as will be described hereinafter. The piston having been driven in a driving stroke will remain at the bottom of the cylinder until the valve core 50*a* returns to its idle position of FIG. 2.

When the valve core 50*a* is returned to idle position, the high pressure air in the chamber 12 passes through the passage 46, valve housing 50, the passage 45, the tube 44 and the passage 43 to the space 42 above the valve 15, causing the valve to seat as before. The air above the piston 14 is exhausted at 27 and then the air in the return air chamber 18, passing through the ports 31, forces the piston 14 back to its starting position.

Figure 6:
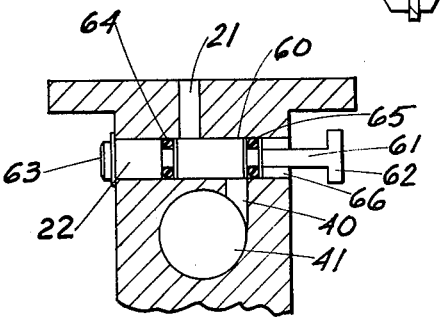
FIG. 6 is a fragmentary cross sectional view on the line 6—6 of FIG. 2 showing the selector valve in the auto-fire position.
Figure 7:
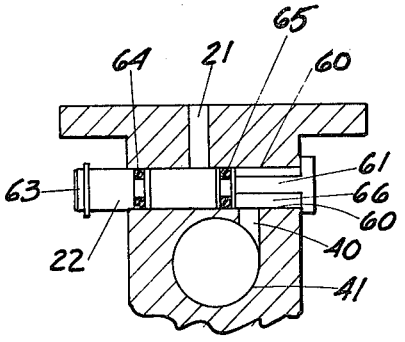
FIG. 7 is a view similar to FIG. 6 showing the selector valve in the single fire position.

FIGS. 6 and 7 show a cross sectional view of the selector valve on the line 6—6 of FIG. 2. Referring now to FIGS. 6 and 7, it will be seen that the body of the tool is provided with a bore 60 and in this bore the selector valve 22 is located. The selector valve 22 has a relatively small diameter extension 61 extending beyond the tool body 10 and provided with an actuating button 62. A similar actuating button 63 is provided at the other end of the valve.

The selector valve 22 has a pair of spaced O-rings 64 and 65. That portion of selector valve 22 between O-rings 64 and 65 is of D-shaped cross section, as can best be seen in FIGS. 2 and 3. It will be noted that when the extension 61 is pushed from its extreme position to the right (FIG. 6) to its extreme position to the left (FIG. 7) the space between the O-rings 64 and 65 remains in communication with the passage 21 which leads to the return air chamber 18. However, in the position of FIG. 6, the passage 40 which communicates with the valve housing 50, is in communication with the space between the O-rings 64 and 65 while in the position of FIG. 7 the passage 40 is in communication with the annular space 66 between the extension 61 and the bore 60.

Thus, in the auto-fire position of FIG. 6, the valve puts the passages 21 and 40 into communication while in the single fire position of FIG. 7 the passage 40 is in communication with the annular space 66 between the bore 60 and the extension 61, which permits exhaust to atmosphere.

The D-shaped cross section makes it possible by rotating the valve 22 within the bore 60 to increase or decrease the flow of air between the passages 21 and 40 in the auto-fire mode, thereby controlling the frequency of fire in the auto-fire mode.

It will be seen that the selector valve 22 and the stationary valve housing 50 of the present invention greatly simplify the operation of an auto-fire tool since there are less moving parts which can wear and cause misfire or failure of the tool.

Figure 5:
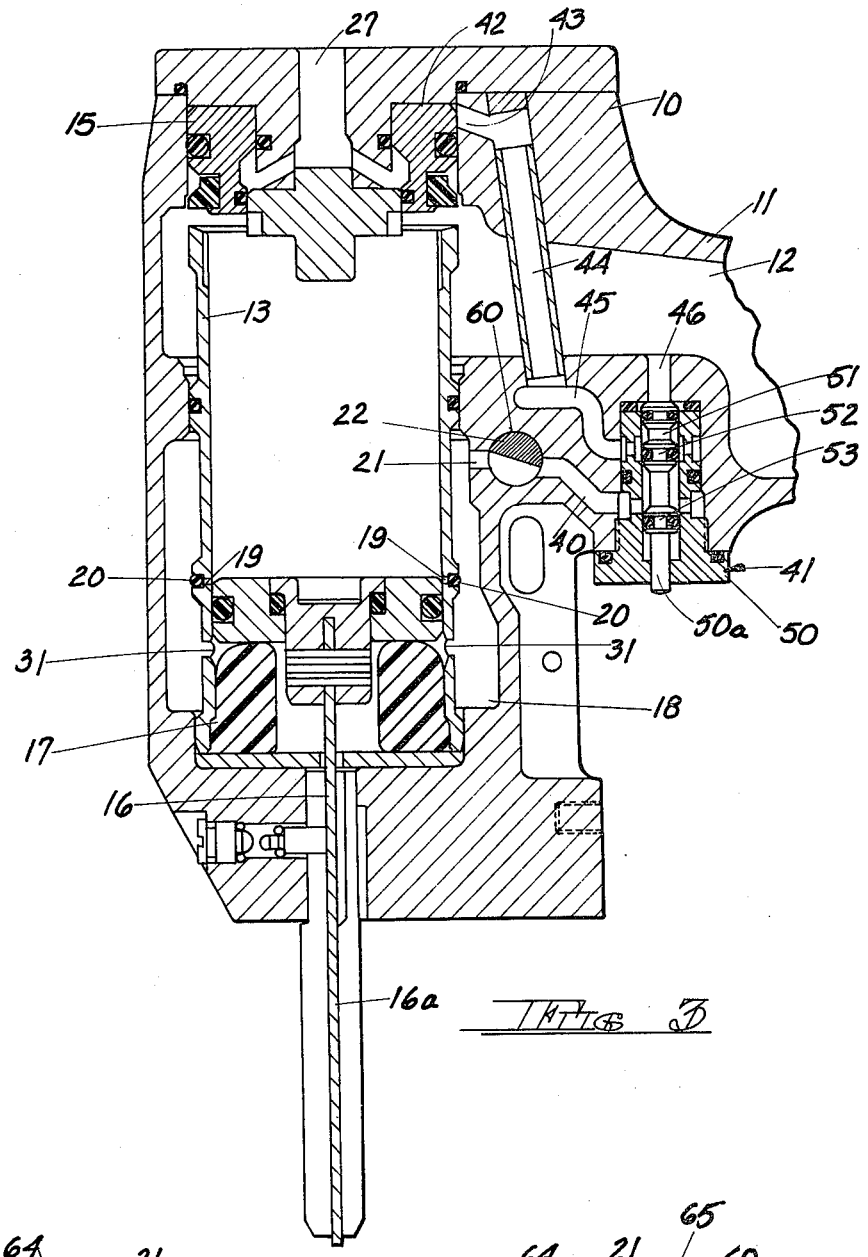
FIG. 5 is a view similar to FIG. 3 showing the modified tool of FIG. 4 in the active position.
Figure 4:
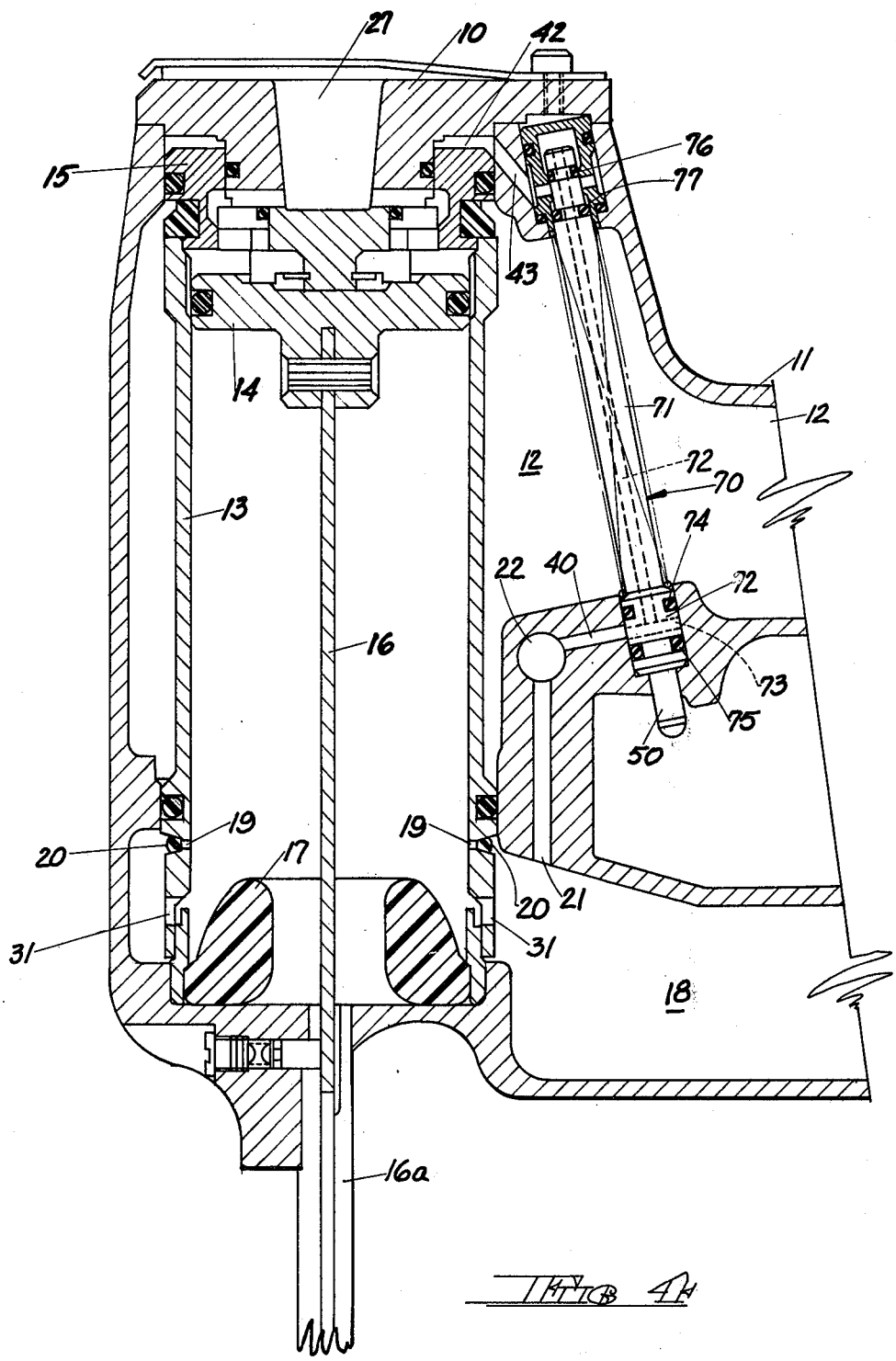
FIG. 4 is a view similar to FIG. 2 of a modification of a tool according to the present invention in the idle position.
Figure 5:
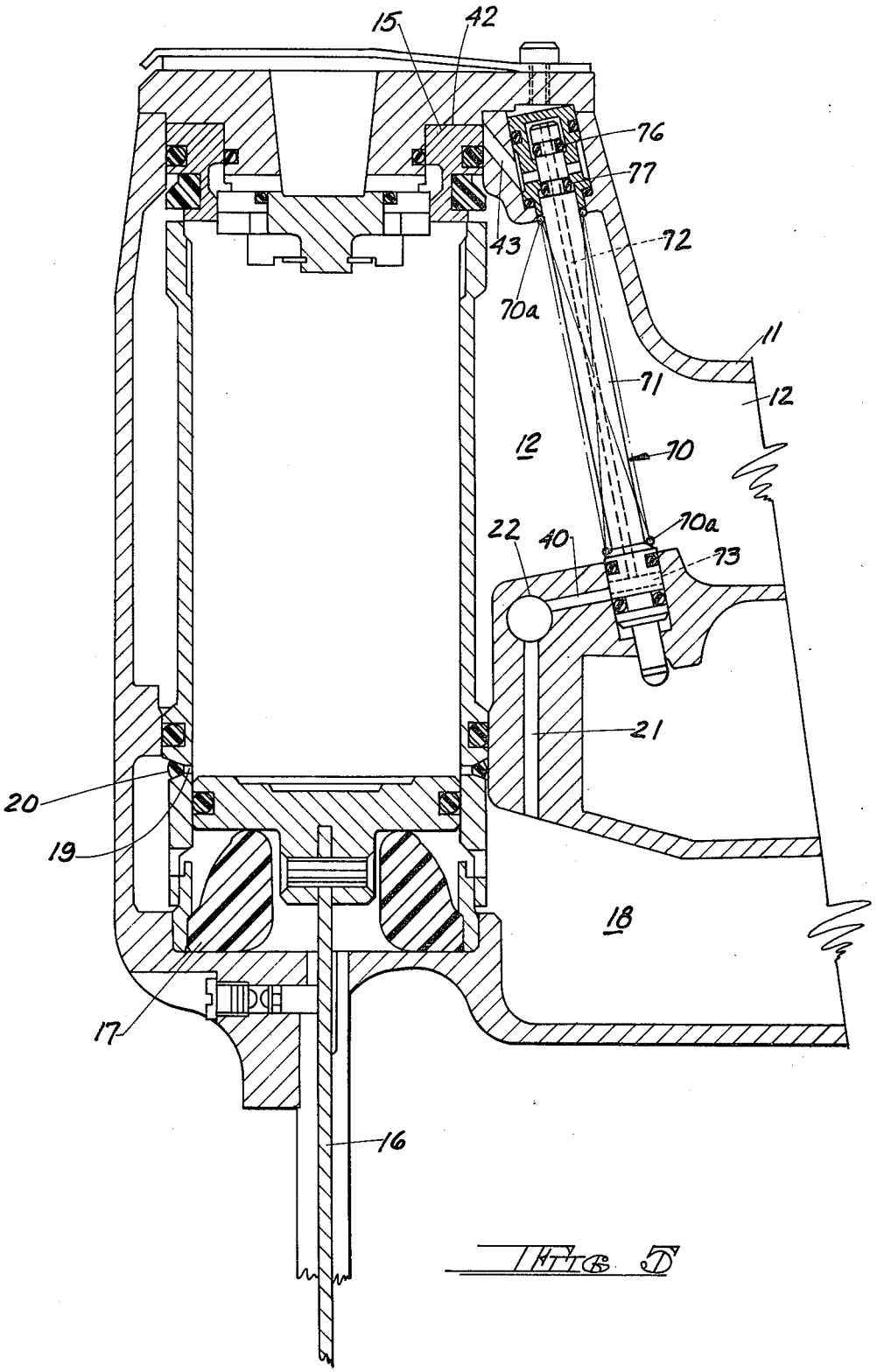

The embodiment shown in the idle position in FIG. 4 and in the active position in FIG. 5 operates on the same principles as the device of FIGS. 2 and 3. It simply is different in structural arrangement. Like parts in FIGS. 4 and 5 have the same reference numerals as in FIGS. 2 and 3. In the modified embodiment, the valve assembly 70 involves an elongated core 71 having an axial bore 72. At the lower end of the core 71 there is a transverse bore 73 communicating with the bore 72. Above and below the bore 73 are O-rings 74 and 75. The bore 73 is in communication with the passage 40 in the idle and in the active position of the core 71.

At the upper end of core 71 there are the valve elements constituted by the O-ring 76 and the O-ring 77. It will be clear that in the idle position of FIG. 4, high pressure air from the space 12 can pass the O-ring 77 and gain access to the passage 43 and thence to the space 42 above the valve 15 to hold it on its seat.

In the position of FIG. 5, which shows the active position of core 71, the air from the space 42 above the main valve 15 can pass through the passage 43 and pass the upper O-ring 76 and thence pass through the bore 72 in the core 71 to the transverse bore 73 and thereafter to the selector valve 22. In the auto-fire position, it can continue through the passage 21 into the return air chamber 18. In the single fire position, of course, it exhausts through the stem of the selector valve 22 as described above.

The valve assembly core 71 is biased to the position of FIG. 4 by the spring indicated at 70*a*.

Clearly, the device of FIGS. 4 and 5 varies only in the arrangement of the parts. It is just as simple as the arrangement of FIGS. 2 and 3 and operates on exactly the same principle.

It will be understood that numerous modifications may be made without departing from the spirit of the invention and therefore no limitation is intended unless specifically set forth in the claims and no such limitation should be implied.

What is claimed is:

1. In a pneumatically actuated fastener applying tool of the type having a tool body adapted to be connected to a supply of air under pressure, a cylinder in said body, a piston and fastener driver reciprocable in said cylinder, a return air chamber in said body, a main valve for supplying air under pressure to said piston for a working stroke, a portion of the underside of said main valve being continuously exposed to air under pressure, a remote valve assembly for actuating said tool, a connection between said remote valve assembly and the upper side of said main valve, said remote valve assembly in the inactive position providing a connection between said air under pressure and the upper side of said main valve, said upper side of said main valve having a greater area than its underside, a connection between said return air chamber and said remote valve assembly, and a selector valve in said last named connection, the improvement wherein said remote valve assembly comprises a one-piece movable core shiftable between an idle position and an active position, said selector valve in one position venting said air under pressure from above said main valve through said remote valve assembly and selector valve to atmosphere to provide a working stroke upon each actuation of said remote valve assembly, said selector valve in another position providing a connection between said return air chamber through said selector valve and remote valve assembly directly to the upper side of said main valve to provide for auto-fire operation of said tool as long as said remote valve assembly is in said active position.

2. The structure claimed in claim 1 wherein said remote valve assembly comprises a valve housing and said core, said valve housing being fixedly mounted in said tool body, said core being axially movable in said valve housing between said idle and said active positions, said valve housing having a first port communicating with said air under pressure, a second port communicating with the upper side of said main valve, and a third port communicating through said selector valve with said return air chamber.

3. The structure claimed in claim 2 wherein said core has three spools, a first spool which in the inactive position of said core opens a passage between said first and second ports, and in the active position closes said first port, a second spool which in the inactive position blocks communication between said second and third ports, and in the active position opens communication between said second and third port, and a third spool which seals said remote valve housing about said core.

4. The structure claimed in claim 3 wherein said selector valve comprises a tubular bore in said body and a selector spool axially slidable in said bore between a single fire position and an auto-fire position, said selector spool having a portion of D-shaped cross section with seals at each end thereof engaging said tubular bore, and having an actuating stem extending from said portion axially of said bore to provide an annular space therebetween, a first port in said bore between said seals in both positions of said selector spool, said bore communicating with said return air chamber, a second port in said bore between said seals in one position of said selector spool, communicating with said remote valve assembly, and in the other position of said selector spool communicating with said annular space, said spool in the single fire position blocking communication between said first and second ports and opening communication between said remote valve assembly and said annular space, said spool in said auto-fire position blocking communication between said remote valve assembly and said annular space, and opening communication between said first and second ports.

5. The structure claimed in claim 4 wherein said spool is rotatable within said bore whereby the communication between said first and second ports may be varied from blocked to wide open, to vary the frequency of firing in said auto-fire position.

6. The structure claimed in claim 1 wherein said core has a transverse bore extending therethrough near its lower end and an axial bore extending from said transverse bore through its upper end, said core being so mounted within said tool body as to be axially shiftable between said idle and active positions, means to bias said core to said idle position, said core being so configured that said transverse bore communicates with said connection containing said selector valve when said core is in said idle and said active positions, when in said idle position said core seals the upper end of said axial bore from said connection with said upper side of said main valve and opens said last mentioned connection to said air under pressure from said source thereof, and when said core is in said active position said last mentioned connection is sealed from said air under pressure from said source and is put into communication with said upper end of said axial bore of said core.

7. The structure claimed in claim 6 wherein said selector valve comprises a tubular bore in said body and a selector spool axially slidable in said bore between a single fire position and an auto-fire position, said selector spool having a portion of D-shaped cross section with seals at each end thereof engaging said tubular bore, and having an actuating stem extending from said portion axially of said bore to provide an annular space therebetween, a first port in said bore between said seals in both positions of said selector spool, said bore communicating with said return air chamber, a second port in said bore between said seals in one position of said selector spool, communicating with said remote valve assembly, and in the other position of said selector spool communicating with said annular space, said spool in the single fire position blocking communication between said first and second ports and opening communication between said remote valve assembly and said annular space, said spool in said auto-fire position blocking communication between said remote valve assembly and said annular space, and opening communication between said first and second ports.

8. The structure claimed in claim 7 wherein said spool is rotatable within said bore whereby the communication between said first and second ports may be varied from blocked to wide open, to vary the frequency of firing in said auto-fire position.

9. The structure claimed in claim 1 wherein said selector valve comprises a tubular bore in said body and a selector spool axially slidable in said bore between a single first position and an auto-fire position, said selector spool having a portion of D-shaped cross section with seals at each end thereof engaging said tubular bore, and having an actuating stem extending from said portion axially of said bore to provide an annular space therebetween, a first port in said bore between said seals in both positions of said selector spool, said bore communicating with said return air chamber, a second port in said bore between said seals in one position of said selector spool, communicating with said remote valve assembly, and in the other position of said selector spool communicating with said annular space, said spool in the single fire position blocking communication between said first and second ports and opening communication between said remote valve assembly and said annular space, said spool in said auto-fire position blocking communication between said remote valve assembly and said annular space, and opening communication between said first and second ports.

10. The structure claimed in claim 9 wherein said spool is rotatable within said bore whereby the communication between said first and second ports may be varied from blocked to wide open, to vary the frequency of firing in said auto-fire position.

* * * * *